United States Patent [19]

Gregorian et al.

[11] 4,427,409

[45] * Jan. 24, 1984

[54] METHOD FOR PREPARATION OF FABRICS

[75] Inventors: Razmic S. Gregorian, Akiken; Chettoor G. Namboodri, North Augusta, both of S.C.

[73] Assignee: United Merchants and Manufactures, Inc., New York, N.Y.

[ * ] Notice: The portion of the term of this patent subsequent to Oct. 3, 1995 has been disclaimed.

[21] Appl. No.: 388,254

[22] Filed: Jun. 14, 1982

[51] Int. Cl.[3] ..... D06L 1/14; D06L 3/00; D01C 3/02

[52] U.S. Cl. ..... 8/107; 8/125; 8/138; 8/139; 8/149.1

[58] Field of Search ..... 8/138, 139, 125, 107, 8/477, 149.1

[56] References Cited

U.S. PATENT DOCUMENTS 4,099,913 7/1978 Walter et al. ..... 8/477
4,118,526 10/1978 Gregorian et al. ..... 8/477

*Primary Examiner*—Maria Parrish Tungol
*Attorney, Agent, or Firm*—Toren, McGeady and Stanger

[57] ABSTRACT

A method for desizing, scouring and/or bleaching and/or mercerizing textile fabrics by foaming a composition containing an appropriate desizing, bleaching or scouring agent and a foam system to a blow ratio from about 2:1 to 30:1 and a foam density in the range from about 0.5 g/cc to 0.033 g/cc. The foam is applied to the surface of the fabric in a uniform thickness and is then collapsed and forced through the fabric. The fabric is then batched to allow the particular desizing agent, bleaching agent, scouring agent or mercerizing agent to be effective and then the fabric is rinsed. With the inventive process, a substantial reduction in the liquid volume normally required for such treatments as well as improved end results are obtained.

6 Claims, No Drawings

METHOD FOR PREPARATION OF FABRICS

BACKGROUND OF THE INVENTION

1. Field of the Invention

This invention relates to the field of preparing textile fabrics for subsequent dyeing and finishing steps. In particular, the invention relates to a novel method for desizing, scouring, bleaching and mercerizing such fabrics.

2. Description of the Prior Art

Conventionally, in the weaving and knitting of textile fibers into fabrics, coatings, e.g., size, are applied to the fiber to facilitate the handling thereof in the weaving and knitting procedures. This size must be removed prior to subsequent treatment of the fabric. In addition, desizing operations are usually carried out in conjunction with either scouring, i.e., cleaning with alkaline agents, bleaching, usually with peroxides, and/or mercerizing, of the fabric in order to whiten the fabric and remove wax therefrom.

In the past, each of these processes, i.e., desizing, scouring, bleaching and mercerizing, was carried out using appropriate agents either dissolved or dispersed in a liquid medium, e.g., water or an organic solvent. This results in the problem that relatively large amounts of liquid medium must be removed from the fabric after the operation. Consequently, a substantial amount of the cost incurred in such processes resides in the liquid medium removal step.

Such liquid media present a further problem in that after they are removed, they must either be disposed of or recovered for reuse. In the case of an aqueous treatment system wherein the liquid medium is water, the water is normally disposed of as waste. In recent years, the environmental problems that related to the disposal of water with residual chemical agents therein have become increasingly important.

With respect to organic solvents as the liquid medium, it is normally desirable to recover them because of the relatively high cost. Obviously, such recovery systems only add to the expense of the overall treatment process. Moreover, disposal of the solvent, if it is desired not to recover it, also presents environmental problems.

The foregoing problems become even more severe when textile fabrics which are highly absorbent are treated. Additionally, because of the relatively large absorption of the liquid, the weight of the wet fabric which is being handled increases significantly, and often results in processing problems and increased expense.

Methods have been developed wherein various types of treating agents, e.g., dyes, anti-crease agents, etc., can be applied to fabrics in the form of a foam. Such methods are directed to avoidance of the problems depicted above in connection with liquid removal. In particular, reference is made to U.S. Pat. Nos. 4,118,526, 4,193,762, 4,208,173, 4,266,976, 4,270,915, 4,282,729 and 4,299,591, the contents of each of which being hereby incorporated by reference.

SUMMARY OF THE INVENTION

We have discovered a method for desizing and/or bleaching and/or scouring and/or mercerizing a textile fabric wherein the disadvantages with respect to the large liquid volumes present in the prior art processes can be avoided. Also, improved whitening and size removal can be effected. This is accomplished by foaming a mixture of diluent liquid, an appropriate desizing agent, bleaching agent, scouring agent and/or mercerizing agent, and a foaming system to a blow ratio in the range from about 2:1 to 30:1, preferably from about 2:1 to 20:1, and a foam density in the range from about 0.5 g/cc to 0.033 g/cc, preferably from 0.5 to 0.05 g/cc. A layer of this foam is then applied in a uniform thickness onto the surface of the fabric to be treated. The foam is then collapsed and forced through the fabric by application of pressure. Thereafter, the fabric is batched in a conventional manner for a period of time sufficient to allow the desizing agent, scouring agent or bleaching agent to be effective. Thereafter, the fabric is rinsed.

The method of the present invention is highly advantageous in that the batch or steaming times required can be substantially decreased often as much as 50%. Since such batch or steam times represent a major time requirement of desizing, bleaching, scouring and mercerizing processes, this represents a substantial cost saving over the conventional processes.

Additionally, with fabrics having dyed and undyed yarns, there is no staining of the undyed yarns, i.e., bleeding of the color from the dyed yarn onto the undyed yarn. This represents a significant advantage of the present process.

DESCRIPTION OF THE PREFERRED EMBODIMENT

Generally, sizes which are used for fabric are either of the soluble type as exemplified by carboxymethyl cellulose and polyvinyl alcohol containing sizes and starch or modified starch sizes, the starch sizes being insoluble in water. A variety of different type desizing agents can be used with each of these. Thus, for example, peroxides which both bleach as well as desize can be used. Additionally, enzymes which have the effect of breaking down the starch and rendering it more soluble in water are well known to the art. Also, while the enzymes do not necessarily completely solubilize the starch, they do facilitate the physical removal of the starch from the fabric, i.e., they have a loosening effect.

More particularly, typical sizes which may be used on fabrics and which can be treated with the process of the present invention, include starches, modified starches, gums, carboxymethyl cellulose, polyvinyl alcohol, synthetic sizes, acrylic sizes, vinyl acetate based sizes and polyether based sizes, waxes and blends of these materials.

Desizing agents, scouring agents, bleaching agents and/or mercerizing agents which may be used in accordance with the present invention, include the following: enzymes, hydrogen peroxide, sodium bromate, hydrochloric acid, sodium percarbonate, perborates, sodium carbonate, sodium chlorate or hypochlorates, sodium hydroxide, sodium silicate and blends of these materials. Of course, other conventional desizing agents may be used so long as they do not have an adverse effect on the foam.

Obviously, the amount of desizing agent, scouring agent, bleaching or mercerizing agent used in the composition will be that amount which is effective to achieve the desired result, i.e, desizing, bleaching, scouring and/or mercerizing. Generally, the amounts of the particular agent are in the following ranges: 0.5–12 wt.% enzyme, preferably 2–8 wt.% for desizing, 0.5–12 wt.% hydrogen peroxide, preferably 1–8 wt. % for bleaching, 0.5–15 wt. % sodium hydroxide (caustic soda) or soda ash (sodium carbonate), preferably 1–10 wt. % for scouring or for a solvent scouring agent (a hydrocarbon soluble surface active agent and hydrocarbon solvent) 10 to 25 wt.%; and for mercerizing 5–35% sodium hydroxide (all weight percents are based on the total weight of the mixture).

The particular desizing agent, bleaching, scouring or mercerizing agent is generally mixed in with an appropriate amount of water and a foaming system. Such foaming systems are composed of a foaming agent. Optionally, such systems may also contain a foam stabilizer, i.e., thickener, and/or an auxiliary foam stabilizer.

In accordance with this invention, foaming agents which may be utilized include materials selected from the following groups of compounds. In the chemical formulas given, M is a cation of group I of the Periodic System of Elements (e.g., sodium, potassium) or a radical of the formula $NR_4+$ wherein R is selected from the group consisting of hydrogen and lower alkyl; and X is a sulfur or phosphorus derivative of the formula

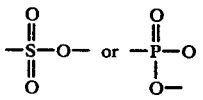

1. Salts of fatty acids represented by the formula:

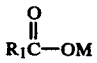

wherein $R_1$ is a hydrocarbon radical of the formula $C_nH_{2n+1}$, $C_nH_{2n-1}$ or $C_nH_{2n-3}$ and n is an integer from 12 to 24. Examples of such materials are ammonium stearate, potassium stearate, ammonium oleate and ammonium ricinoleate.

2. Salts of inorganic esters of aliphatic alcohols represented by the formula:

$$R_2—CH_2OXM_m$$

wherein $R_2$ is a hydrocarbon radical $C_nH_{2n+1}$ (wherein n is an integer from 11 to 23) and m is either 1 or 2. Examples of such materials are ammonium lauryl sulfate, sodium tetradecyl sulfate and the sodium salt of the phosphate ester of tridecyl alcohol.

3. Salts of inorganic esters of oxyalkylated aliphatic alcohols of the formula

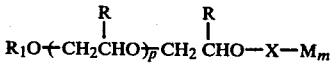

wherein p is an integer from 0 to 50 and R, $R_1$, X, M and m are as previously defined. Commercially available examples of such materials are Alfonic ester sulfate (Conoco Chemicals) and Alipal CD-128 (GAF Corp.).

4. Salts of organic esters of oxyethylated higher alkyl phenols of the formula

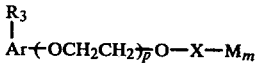

wherein $R_3$ is a higher alkyl of $C_nH_{2n+1}$ (n=8 to 14), Ar is phenyl or naphthyl, and X, M, m and p are as previously defined. Such products are commercially available under the tradenames Alipal CO-433 and Alipal CO-436 (GAF Corp.).

5. Salts of substituted sulfosuccinates represented by the formula:

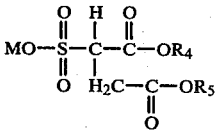

wherein $R_4$ is a higher alkyl, an ethoxylated higher alkyl or an ethoxylated alkylphenyl, and $R_5$ is $R_4$ or M. Commercially available examples of these compounds, from American Cyanamid, are Aerosol OT, Aerosol A-102 and Aerosol A-103.

6. Salts of N-substituted sulfosuccinamates of the formula

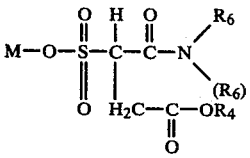

wherein $R_6$ is a higher alkyl. An example of such a material is Aerosol-18 (American Cyanamid).

7. Block and graft copolymers of polyoxyalkyl and polydialkylsiloxy groups of the formula:

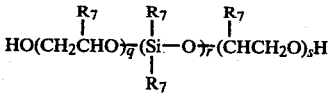

wherein $R_7$ is a lower alkyl and q, r and s are integers from about 2 to 100, or

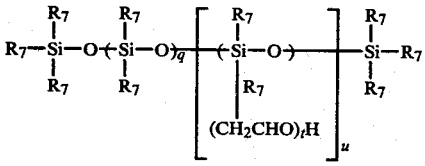

where t and u are integers from 2 to 100, and $R_7$ and q are as defined above. An exemplary material is Silicone 471-A (Dow Corning).

8. Salts of sulfonated paraffin hydrocarbons of the formula:

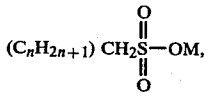

such as Alkanol 189-S (duPont).

9. Salts of sulfonated higher alkyl aromatic hydrocarbons represented by

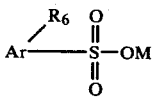

wherein Ar and $R_6$ are as earlier defined, for example, the sodium salt of dodecylbenzene sulfonic acid.

10. Oxyalkylated higher alkyl phenols of the formula:

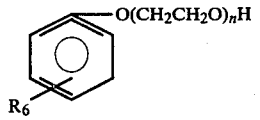

wherein n is an integer from 10 to 100 and $R_6$ is as previously defined. Examples of such compounds are Igepal CO-210 and RC-630 (GAF Corp.).

11. Alkyltrimethylammonium halides of the formula:

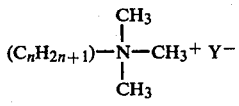

wherein n is an integer from 6 to 24 and Y is a halogen, such as, Cl or Br. Suitable materials are the trimethyltallow ammonium chlorides (available from Onyx Chemical Co.).

12. Alkyl amine oxides of the formula:

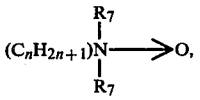

n=12 to 24
such as Barlox 10 S and Barlox 14 (Lonza Chemical Co.) and Textamine Oxide CA (Textilana Corp.).

13. Alkyl pyridinium halides of the formula:

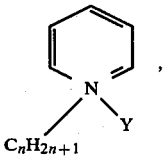

n=12 to 24,
such as Cetyl pyridinium bromide (Aceto Chem. Co.).

14. Alkyl morpholinium halides represented by

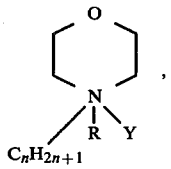

n=12 to 24,
such as Atlas G 271 (ICI).

15. Condensation products of fatty acids with 1 or 2 moles of a primary or secondary alkanolamine. For example, these product are complex mixtures known as Kritchevsky bases. Suitable materials within this group are Valdet CC (Valchem).

16. Condensation products of fatty acids and ethylene amines and substituted ethylene amines of the formula, for example,

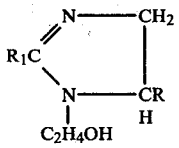

such as, Amine 220 (Union Carbide) and Antaron MC-44 (GAF Corp.).

17. Block copolymers of propylene oxide and ethylene oxide represented by

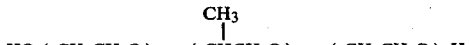

or

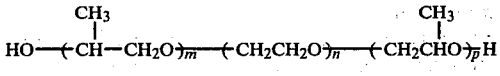

wherein m, n and p are integers from about 10 to 100. Exemplary materials are the family of compounds known as Pluronics from Wyandotte Chem. Co.

18. Fatty acid betaines of the formula

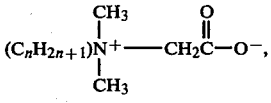

n=12 to 24,
such as, ALkateric CAB (Alkard Chemicals).

19. Fluorocarbon surfactants, such as, the family of Zonyl surfactants (anionic, cationic, nonionic) (duPont) and Fluorad surfactants (3M Co.).

20. Oxylated aliphatic alcohols of the formula $$C_nH_{2n+1}O(CH_2CH_2O)_mH$$

n=8 to 14, m=1 to 100,
such as, Alfonic 1218-60. Emulphogene BC420, Valdet 4016 or Siponic E-3.

Foam stabilizers may also be used in conjunction with the noted foaming agents to obtain added foam stability. Suitable foam stabilizers or thickeners include polyacrylic acid, copolymers of acrylic acid, polyvinyl alcohol, natural gums, starches, starch derivatives, cellulose derivatives, synthetic polymeric compounds, water soluble polymers, organic solvent soluble polymers and blends of those compounds.

Auxiliary foam stabilizers may also be used in conjunction with the foaming agent or with the foaming agent and thickeners to obtain added foam stability. Auxiliary foam stabilizers include aliphatic alcohols, e.g., lauryl alcohol, or stearic alcohol, dodecyl alcohol, aliphatic acids, e.g., lauric acid or other fatty acids, fatty acid esters, phosphate esters, hydrophilic polymers, such as, agar, polyvinyl alcohol, and sodium alginate as well as blends of these compounds. Also included are ethoxylated aliphatic alcohols and acids having a low HLB value, preferably lower than 10.

Typical liquid media which may be used include water, perchloroethylene, trichloroethylene, and other conventional solvents, e.g., chlorinated hydrocarbons and aliphatic and aromatic hydrocarbon and petroleum solvents. Additional optional components which may be added to the composition include: wetting agents, salts, buffering agents for alkali or acid, peroxide stabilizers and such conventional additives.

Generally, the composition of the present invention is capable of being whipped into a foam having a blow ratio in the range from about 2:1 to 30:1, and preferably, from about 2:1 to 20:1. The blow ratio is determined by measuring the weight of a given volume of the foam compared to the weight of the same volume of the composition prior to foaming. The foam density range is generally from about 0.5 g/cc to 0.033 g/cc and preferably from about 0.5 to 0.05 g/cc.

In order to be suitable for use in the present invention, it is important that the foam be sufficiently stable so that it does not collapse between the time when the initial foaming takes place and the time when it is applied to the fabric. The blow ratios and foam densities noted above should be stable, i.e., undergo minimal change, during the period from at least about 20 minutes and up to 24 hours after formation. Consequently, not all types of foams can be used in the present invention. For example, those foams which are of the soap bubble type, do not have sufficient stability to withstand the treatment of the coating process. When foams of this type are applied to the fabric, they immediately collapse and result in spotting and non-uniform application of the finishing agent.

More particularly, the process of the present invention is carried out by first mixing the appropriate components for the foamable composition, i.e., desizing agent, bleaching agent, and/or scouring agent and/or mercerizing agent along with the foaming agent and liquid diluent, i.e., organic solvent, water, or dispersing liquid, and then foaming this composition utilizing a suitable mechanical foaming device, e.g., an Oakes, Godwin card, including static foamers, etc. The composition, after foaming, is transferred using either a knife, horizontal pad, or other conventional means for applying a layer of the foam to the fabric. The foam on the fabric is then collapsed by conventional means so that it penetrates throughout the fabric. The collapsing of the foam causes uniform penetration and application of the particular agent through the fabric. Thereafter, the fabric is batched for an appropriate period of time, depending on the specific desizing, bleaching, scouring or mercerizing agent used to permit the chemical interaction between the agent and the fabric. Such batching techniques are conventional. Alternatively, the fabric may be subjected to conventional atmospheric steaming rather than batching.

After batching or steaming, the fabric is treated, as by washing with water, to remove the desizing agent along with the size which has either been solubilized or loosened from the fabric. Thereafter, the fabric can be dried and/or subjected to further treatment. If required, the fabric may be neutralized prior to any subsequent treatment.

The following examples illustrate the present invention.

In the examples, a number of materials are used and identified by trademark and in some cases by their chemical name. The following is a table of the trademarked materials, the chemical designation, their function in the examples, and the manufacturer.

| Trademark | Chemical Name | Function | Manufacturer |
|---|---|---|---|
| VALFOAM RF | coconut fatty acid diethanolamide composition | foaming agent | Valchem |
| VALFOAM MD | sodium lauryl sulfate composition | foaming agent | Valchem |
| EXSIZE TX ENZIME | commercial enzyme | desizing agent | Premier Malt |
| UNAMIDE N-72-3 | coconut fatty acid diethanol amide | foaming agent | Lonza |
| SUNELOX | | peroxide stabilizer | Pennwalt Corp. |
| PENELOX | sodium ortho silicate | peroxide stabilizer | Pennwalt Corp. |
| OMEGA SCOUR 1116 | high boiling hydrocarbon or chlorinated hydrocarbon plus surfactant | solvent scouring agent | Omega Chem. Co. |
| VALDET CC | coconut fatty acid diethanol amide | wetting agent | Valchem |
| HIVAL RS | aliphatic hydrocarbon based solvent scouring agent | | Valchem |
| HIVAL 5023 | blend of solvent and surfactants scouring agent | | Valchem |
| OMEGA 418 | | peroxide stabilizer | Omega Chem. Co. |
| OMEGA 383 | phosphate based | scouring agent | Omega Chem. Co. |
| TEXPRO | | wetting agent | Pennwalt Corp. |
| BARLOX 10S | decyl dimethylamine oxide N,N—dimethyldecylamine N—oxide | foaming agent | Lonza |
| ANTARON FC-34 | fatty acid imidazoline surfactant | foaming agent | GAF Corp. |
| ALIPAL CO-433 | salt of 2-sulfated ethoxylated nonylphenol | foaming agent | GAF Corp. |
| VALDET-4016 | ethoxylated aliphatic alcohol | foaming agent | Valchem |

EXAMPLE 1

FOAM BLEACHING UTILIZING A PEROXIDE FOAM

A striped greige fabric containing dyed yarn and having a carboxymethyl cellulose size thereon was bleached as follows to remove the size and to produce whiteness in the undyed portion of the fabric with the avoidance of bleeding of the colors and staining of the white portion of the fabric. A composition was prepared containing 3 parts hydrogen peroxide (35% solution), 1.5 parts sodium silicate, 10 parts Valfoam RF, and 86 parts water. The pH was 10.5. The composition was foamed to an 8:1 blow ratio utilizing a Kitchen Aid mixer. The foam was applied to samples of a greige fabric containing dyed yarns utilizing a horizontal pad on both sides prior to the fabric entering the nip and was simultaneously collapsed onto the fabric. The samples were batched wet for 6 hours in a plastic bag and then rinsed with hot and cold water and finally dried.

This procedure produced complete removal of the size and satisfactory bleaching of the white portion of the fabric without bleeding of the color from the dyed yarn or staining of the white portions of the fabric.

EXAMPLE 2

FOAMS DESIZING AND SCOURING

A 50/50 polyester/cotton blend fabric having a starch size thereon was subjected to foam desizing and subsequent foam scouring in the following manner:

A composition containing 5 parts Exsize TX Enzime, 5 parts Valfoam RF and 90 parts of water was foamed to an 8:1 blow ratio. The foam was padded on the greige fabric samples and the wet fabric was batched for 4 hours in the same manner as in Example 1. The samples were then rinsed with hot and cold water. An iodine test showed that the starch size had been completely removed from the fabric.

The thus obtained desized fabrics were subjected to foam scouring in the following manner:

A composition containing 2.5 parts of caustic (50% solution), 5 parts Valfoam RF and 92.5 parts water was foamed to an 8:1 blow ratio. The foam was padded onto two of the foam desized fabric samples and they were cold batched for 4 hours. Thereafter, the samples were rinsed and dried in the manner of Example 1 to produce the appropriately scoured and cleaned fabrics.

EXAMPLE 3

FOAM DESIZING AND FOAM BLEACHING

A composition was prepared by mixing 5 parts of Exsize TX Enzime, 2 parts Unamide N-72-3, and 93 parts of water. It was then foamed to a blow ratio of 8:1. The foam was padded onto a stripped fabric containing a dyed yarn utilizing a horizontal pad. In horizontal padding, the foam was applied to both sides of the fabric prior to it entering the nip. At the nip, the foam collapsed and ensured uniform penetration of the Enzime into the fabric.

Thereafter, the fabric was cold batched over night. The samples were then rinsed utilizing hot and cold water and squeezed to remove excess water.

The thus desized samples were bleached by application of a foamed composition prepared from 3 parts hydrogen peroxide (35% solution), 1.5 parts of sodium silicate, 10 parts of Valfoam RF and 86 parts of water. The pH of this composition was 10.5. The composition was foamed to an 8:1 blow ratio and two of the foam desized samples were padded with a peroxide foam using a horizontal pad. They were then cold batched for 6 hours and rinsed and dried in the usual manner. All of the size had been removed from the fabric and foam bleaching provided excellent whiteness on the undyed portion of the striped fabric without bleeding of the color or staining of the white portions.

EXAMPLE 4

A greige cotton fabric and a 50/50 polyester/cotton blend fabric having a starch size thereon were treated as follows:

A foamable hydrogen peroxide composition containing 91.9 parts of water, 1 part of Barlox 10S, 0.1 part Sunelox, 1 part Penelox, and 6 parts of hydrogen peroxide (35% solution) was prepared. The mixture had a pH of 11.5. The composition was foamed to a blow ratio of 15:1 and 15 mils thickness of foam was knife coated onto the greige cotton sample and the greige 50/50 polyester/cotton blend sample. The samples were padded to force the foam through the fabric. The fabric samples were then wet batched for 4 hours.

A second composition containing 88 parts of water, 4 parts Omega scour 1116, 6 parts of caustic (50% solution), and 2 parts of Barlox 10S was prepared. This composition had a pH of 12. The composition was foamed to a 12:1 blow ratio and was knife coated on the peroxide wet batched fabrics by wet-on-wet application. By wet-on-wet application, an intermediate drying step was eliminated. The thickness of the foam was 25 mils. The fabric samples were then padded and the thus treated samples were steamed at 210° F. for 1½ hours. After the steaming, the samples were washed in cold water to remove the soubilized size and the samples were then dried. The thus treated samples exhibit excellent absorbency and the starch indicator test showed that the starch size had been completely removed.

EXAMPLE 5

A side-by-side comparison utilizing percarbonate in place of peroxide for the purpose of bleaching was carried out. Two compositions were prepared having the following components.

| Percarbonate (A)* | | Peroxide (B) | |
|---|---|---|---|
| Water | 93.0% | Water | 93.7% |
| Valdet cc | 1.0 | Valdet cc | 1.0 |
| | | Penelox (silicate) | 1.0 |
| | | Sunelox (peroxide stabilizer) | 0.1 |
| sodium percarbonate | 6.0 | hydrogen peroxide (50%) | 4.2 |
| pH = 10.4 | | pH = 10.6 | |

*The concentration level of percarbonate was adjusted in (A) to give about the same level of peroxide activity as in (B).

A gingham fabric containing starch-PVA-wax blend type size was used for the experiment.

The compositions were foamed to a blow ratio of 15:1 and applied to greige polyester/cotton gingham check fabrics utilizing a knife coater. The fabrics were padded to a 40% wet pick-up by controlling the blow ratio and coating height. The samples were batched for 4 hours each. For batching, the wet fabric samples were kept in plastic bags to avoid moisture loss and stored at room temperature for 4 hours. Then the samples were washed and dried.

The whiteness of each of the fabrics on the undyed portions was essentially equivalent. The thus obtained fabrics were analyzed for the amount of size remaining (starch/polyvinyl alcohol size) as well as the amount of wax. The following results were obtained:

| | Starch/PVA Size | Wax |
|---|---|---|
| Control (undesized) | 8.56% | 0.46% |
| Sample A (percarbonate desized) | 0.26% | 0.32% |
| Sample B (peroxide desized) | 0.34% | 0.23% |

The percarbonate foam desizing method gave essentially the same results as peroxide in removing size and obtaining whiteness in the undyed portions of fabric.

EXAMPLE 6

A comparison of the use of the foam treatment of the present invention with the methods used conventionally in fabric treatment plants using a 50/50 polyester/rayon blend fabric was carried out. Specifically, three different processes were carried out. Process A was the application of a foamed peroxide composition followed by steaming at 210° F. for 10 minutes and washing. Process B involved the foam application of the same composition utilizing process A, followed by batching for 3 hours and subsequent steaming and washing. Process C was the conventional plant preparation of fabrics.

For processes A and B, the following composition was utilized:

6% of Hival RS,
3% of caustic (50% solution),
2% of hydrogen peroxide (50% solution),
3% of Valdet CC.

The composition was foamed to a blow ratio of 8:1. A first sample of fabric (style name County Down) was padded on a horizontal pad with a wet pick-up of 44%. The second sample (style name Tonkin) was padded to a wet pick-up of 54% (County Down and Tonkin are style names of two United Merchants and Manufacturer's fabrics).

For the conventional processing (process C), a composition was prepared containing 1% Omega 418 (peroxide stabilizer),
0.5% Omega 383 (phosphate based scouring agent) and
1.8% of caustic (50% solution), along with
0.9% of hydrogen peroxide (50% solution). This composition was padded onto the fabrics. The wet pick-up of fabric No. 1) was 80% and the wet pick-up of fabric No. 2 was 90%. The thus treated fabrics were then steamed for 10 minutes and washed.

The fabrics were analyzed for the amount of residual size remaining and the following results were obtained:

| Procedure | | % Residual Size Left | |
|---|---|---|---|
| | | % Starch | % Wax |
| | Control (unscoured greige) | | |
| | 1. County Down (Fabric #1) | 5.69 | 0.76 |
| | 2. Tonkin (Fabric #2) | 4.83 | 0.59 |
| A. | Foam prepared by applying Caustic/Hival/Peroxide foam Steam and washed | | |
| | 1. County Down (Fabric #1) | 3.39 | 0.07 |
| | 2. Tonkin (Fabric #2) | 1.75 | 0.10 |
| B. | Foam apply-batch-steam wash | | |
| | 1. County Down (Fabric #1) | 3.23 | 0.17 |
| | 2. Tonkin (Fabric #2) | 4.01 | 0.13 |
| C. | Conventional Scour Omega Scour/Caustic Peroxide Steam and Wash | | |
| | 1. County Down (Fabric #1) | 2.23 | 0.31 |
| | 2. Tonkin (Fabric #2) | 3.36 | 0.15 |

The above data shows that the foam application followed by steaming and washing (method A) provided improved wax removal as compared to the conventional plant procedures.

EXAMPLE 7

PLANT TRIALS OF FOAM PEROXIDE DESIZING AND BLEACHING

Approximately 500 yards of 50/50 polyester/cotton yarn dyed check fabric was treated with the following composition:

10% of Valfoam RF, coconut fatty acid diethanolamide based foaming agent—Valchem, (41 lbs. 8 oz.),
0.05% Texpro, wetting agent—Pennwalt Corp., (2.5 oz.),
0.1% Sunelox, peroxide stabilizer—Pennwalt Corp., (5 oz.),
1.0% Penelox, sodium orthosilicate—Pennwalt Corp., (4 lbs. 2 oz.),
6% hydrogen peroxide (35% aqueous solution—slowly added, 25 lbs.).

Water was added to give a total volume of 50 gallons (82.85% water).

The pH of this mixture was 11.0 and its temperature was 60° F.

This mixture was continuously foamed utilizing a Godwin foamer to a blow ratio of 15:1 using a long hose. The foaming conditions used were as follows:

| | |
|---|---|
| Line pressure | 75 psi |
| Back pressure | 30 psi |
| (Changed to 42 psi when valves were opened to padder. Blow ratio at the padder was 17:1.) | |
| Air flow gauge | 20 |
| Roto Speed | 275 RPM |
| Pump Speed | 200 RPM |

The foam was applied to 500 yards of the fabric by horizontal padding at a speed of 60 yds/min utilizing an 8 ton pressure (wet pick-up was about 40%). The thus treated fabric was batched wet and rotated on the batch roll for 4 hours. The fabric was then open width washed on a washing range and can dried. As compared to conventionally desized bleached fabric, the foam bleached check fabric exhibited superior whiteness on the check white portions. Also, color bleeding was not observed. Generally, this foam bleaching plant run was conducted smoothly without technical problems.

EXAMPLE 8

A series of studies were carried out as to the effect of the foam treatment of the present invention in connection with soluble sizes, such as, polyvinyl alcohol and carboxymethyl cellulose on gingham fabrics and starch sizes on cotton and polyester/cotton blend fabrics as follows:

I. Study of Peroxide Foam Desizing and Bleaching on Soluble Sizes on Gingham Fabrics Two types of gingham fabrics containing soluble polyvinyl alcohol/carboxymethyl cellulose sizes were subjected to peroxide foam desizing. Fabric A was a 50/50 polyester/cotton gingham and fabric B was a 65/35 polyester/cotton gingham. Table 1 hereinafter shows the compositions for the peroxide desizing for both the composition which was foamed as well as the composition used in the conventional process. The same formulations were used for both 50/50 and 65/35 polyester cotton blend fabrics.

TABLE 1

| Foam | | Conventional | |
|---|---|---|---|
| Water | 91.9% | Water | 95.95% |
| Valdet CC | 1.0% | Valdet CC | 0.5% |
| Penelox (sodium orthosilicate) | 1.0% | Penelox | 0.5% |
| Sunelox | 0.1% | Sunelox | 0.05% |
| Hydrogen Peroxide (35% solution) | 6.0% | Hydrogen peroxide | 3.0% |
| Blow Ratio | 15:1 | | |
| Wet pick-up | 35% | Wet pick-up | 70% |

Foam was applied by horizontal padding and wet batching for 4–6 hours followed by washing and drying. For conventional treatment, the fabrics were padded and were batched for 4–6 hours followed by washing and drying.

Table 2 shows the results obtained in terms of the percentage of size remaining as an extractable on the fabrics treated by both the above-described foam desizing method and the conventional peroxide pad method.

TABLE 2

| Method | | % Size Remaining as Extractables |
|---|---|---|
| 1. Control (undesized gingham fabric #1) | (a) total extractables | 7.51% (initial size) |
| | (b) PVA size | 6.25% |
| 2. Conventional peroxide pad batch desizing (4 hr. batching) | (a) total extractables | 3.60% |
| | (b) PVA size | 2.52% |
| 3. *Foam peroxide and batch desizing (4 hr. batching) | (a) total extractables | 3.24% |
| | (b) PVA size | 1.96% |

*The whiteness of foam desized gingham fabric was superior to conventionally peroxide desized samples.

The amount of the residual size left on the fabric is clearly lower utilizing the foam process of the present invention. Additionally, the whiteness on the check fabric was superior to that obtained utilizing conventional procedures.

In Table 3, results utilizing a variety of surfactants as foaming agents are compared in the foam peroxide desizing treatment of the present invention. Additionally, the effect of batching times of 4 hours, 6 hours and 24 hours are compared for each surfactant. The fabric used for the tests in Table 3 was the 65/35 polyester/cotton gingham fabric.

TABLE 3

FOAM PEROXIDE DESIZING OF GINGHAM FABRICS EVALUATION OF FOAMING AGENTS

| Foaming Agent | Extractables left on Fabric 4 hr. Batching | 6 hr. Batching | 24 hr. Batching |
|---|---|---|---|
| 1. Control Gingham fabric (#2) 65/35 polyester/cotton - undesized | — | — | 13.00% (initial size) |
| 2. 1% Valdet CC (fatty acid diethanolamide - Valchem) | 1.75 | 1.80 | 1.37% |
| 3. 1% Antaron FC-34 (fatty acid imidazoline surfactant - GAF Corp.) | 1.24 | 1.72 | 1.86% |
| 4. 1% Alipal CO-433 (salt of 2 sulfated ethoxylated nonylphenol - GAF Corp.) | 2.24 | 1.86 | 1.15% |
| 5. 1% Valdet-4016 (ethoxylated fatty alcohol - Valchem) | 1.54 | 1.63 | 1.29% |

TABLE 3-continued

FOAM PEROXIDE DESIZING OF GINGHAM FABRICS EVALUATION OF FOAMING AGENTS

| Foaming Agent | Extractables left on Fabric 4 hr. Batching | 6 hr. Batching | 24 hr. Batching |
|---|---|---|---|
| 6. 1% sodium lauryl sulfate (25% active) | 2.19 | 1.32 | 2.02% |
| 7. 1% Am. lauryl/sulfate (28% active) | 1.65 | 2.33 | 1.95% |

II. Study of the Effect of the Foam Treatment of the Present Invention on Cotton and Polyester/Cotton Blend Fabrics having a Starch Size thereon The fabrics treated were:

(a) 100% cotton greige goods (3.5 oz/sq.yd), and (b) 50/50 polyester/cotton greige goods (3.0 oz/sq.yd).

These fabrics were treated utilizing the following procedures:

| Conventional | Foam |
|---|---|
| 1. Pad hydrogen peroxide/silicate | 1. Foam hydrogen peroxide/silicate and apply on fabric |
| 2. Batch 4–6 hrs. | 2. Batch 4–6 hrs. |
| 3. Pad caustic/scouring assistants wet on wet | 3. (a) Foam caustic/scouring assistants conventionally wet on wet or (b) Pad caustic/scouring assistants conventionally wet on wet, |
| 4. Steam 210° F.; 1–1½ hr. | 4. Steam 210° F., 1–1½ hrs. |
| 5. Cold water wash | 5. Cold water wash |

Table 4 sets forth the formulations used as well as the procedures for the 100% cotton greige fabric. Table 5 shows the formulations and procedures for the 50/50 polyester/cotton greige fabric. It is noted that substantial advantage in terms of wet pick-up was obtained with the 100% cotton greige fabric, i.e., the wet pick-up with the foam treatment was only 40% as compared to 80% utilizing the conventional treatment.

TABLE 4

FOAMABLE COMPOSITIONS V. CONVENTIONAL FORMULATIONS FOR 100% COTTON FABRIC AND PROCEDURE

| (A) Conventional | | (B) Foam* | |
|---|---|---|---|
| 1. Desizing Peroxide | | 1. Desizing Peroxide Foam | |
| Water | 95.95% | Water | 91.9% |
| Valdet CC | 0.5% | Valdet CC | 1.0% |
| Sunelox | 0.05% | Sunelox | 0.1% |
| Penelox | 0.5% | Penelox | 1.0% |
| Hydrogen Peroxide 35% active | 3.0% | Hydrogen Peroxide 35% active | 6.0% |
| Pad % wet pick-up | 80% | Pad % wet pick-up | 40% |
| Cold Batch: | | Cold Batch: | |
| 2 samples | 4 hrs. | 3 samples | 4 hrs. |
| 2 samples | 6 hrs. | 3 samples | 6 hrs. |
| 2. Caustic Scour (wet on wet) | | 2. Caustic Scour Foam (wet on wet) | |
| Water | 94% | Water | 88% |
| Hival-5023 | 2% | Hival-5023 | 4% |
| Caustic (50%) | 3% | Caustic (50%) | 6% |
| Valdet CC | 1% | Valdet CC | 2% |
| | | Foam 15:1 | |
| Padded wet on wet | | Applied wet on wet | |
| Steamed 1 hr. atmospheric | | Steamed 1 hr. atmospheric | |
| 210° F. - Washed in cold water and dried | | 210° F. - Washed in cold water and dried. | |
| | | 3. Caustic Scour - Conventional on sample from 1. (wet on wet) | |

TABLE 4-continued

FOAMABLE COMPOSITIONS V. CONVENTIONAL FORMULATIONS FOR 100% COTTON FABRIC AND PROCEDURE

| (A) Conventional | (B) Foam* | |
|---|---|---|
| | Water | 94% |
| | Hival-5023 | 2% |
| | Caustic (50%) | 3% |
| | Valdet CC | 1% |
| | Padded wet on wet | |
| | Steamed 1 hr. atmospheric 210° F. - Washed in cold water and dried. | |

*Foam applications were made by two side horizontal padding

TABLE 5

FOAMABLE COMPOSITIONS V. CONVENTIONAL FORMULATIONS FOR 50/50 POLYESTER/COTTON BLEND AND PROCEDURE

| (A) Conventional | | (B) Foam* | |
|---|---|---|---|
| 1. Desizing Peroxide | | 1. Desizing Peroxide Foam | |
| Water | 93.22% | Water | 91.9% |
| Valdet CC | 0.8% | Valdet CC | 1.0% |
| Sunelox | 0.08% | Sunelox | 0.1% |
| Penelox | 0.8% | Penelox | 1.0% |
| Hydrogen Peroxide (35% active) | 5.0% | Hydrogen Peroxide (35% active) | 6.0% |
| | | Foam 15:1 | |
| Padded % wet pick-up | 50% | Padded % wet pick-up | 40% |
| Cold Batch: | | Cold Batch: | |
| 2 samples | 4 hrs. | 3 samples | 4 hrs. |
| 2 samples | 6 hrs. | 3 samples | 6 hrs. |
| 2. Caustic Scour (wet on wet) | | 2. Caustic Scour Foam (wet on wet | |
| Water | 94% | Water | 88% |
| Hival-5023 | 2% | Hival-5023 | 4% |
| Caustic (50%) | 3% | Caustic (50%) | 6% |
| Valdet CC | 1% | Valdet CC | 2% |
| | | Foam 15:1 | |
| Padded wet on wet | | Applied wet on wet | |
| Steamed 1 hr. atmospheric 210° F. - Washed in cold water and dried | | Steamed 1 hr. atmospheric 210° F. - Washed in cold water and dried. | |
| | | 3. Caustic Scour - Conventional on sample from 1. (wet on wet) | |
| | | Water | 94% |
| | | Hival-5023 | 2% |
| | | Caustic (50%) | 3% |
| | | Valdet CC | 1% |
| | | Padded wet on wet | |
| | | Steamed 1 hr. atmospheric 210° F. - Washed in cold water and dried. | |

*foam applications were made by two side horizontal padding

Table 6 sets forth the residual size on the 50/50 blend as treated by both the foam method of the present invention and the conventional procedure. Table 7 sets forth the same analysis on the 100% cotton fabric. It is clear from these results that the present process produces at least equivalent size removal as compared to the conventional process. Also, it is noted that in the final rinsing operation, it is possible to use cold water as opposed to the conventional mill process of using hot water to rinse off solubilized sizes.

TABLE 6

Starch Size on 50/50 Polyester/Cotton Blend

| Sample No. | Process Sequence | % Residual Size left on Fabric after Prep. Peroxide Batching 4 hr. | 6 hr. |
|---|---|---|---|
| 1 | Control 50/50 polyester/ cotton (not prepared) | — | 12.7% (init. size) |
| 2. | Conventional peroxide treatment and conventional caustic pad-steaming | 1.58% | 1.44% |
| 3. | Foam peroxide treatment and conventional caustic pad steaming | 1.21 | 1.37% |
| 4. | Foam peroxide treatment and foam caustic pad-steaming | 1.79% | 1.37% |

TABLE 7

Starch Size on 100% Cotton Fabric

| Sample No. | Process Sequence | % Residual Size left on Fabric after Prep. Peroxide Batching 4 hr. | 6 hr. |
|---|---|---|---|
| 1 | Control 50/50 polyester/ cotton (not prepared) | — | 14.4% (init. size) |
| 2. | Conventional peroxide treatment and conventional caustic pad-steaming | 4.08% | 2.39% |
| 3. | Foam peroxide treatment and conventional caustic pad steaming | 2.52% | 2.65% |
| 4. | Foam peroxide treatment and foam caustic pad-steaming | 2.61% | 2.76% |

EXAMPLE 9

FOAM TREATMENT TO MINIMIZE RESIDUAL WAX ON POLYESTER/RAYON BLEND

Three different procedures were carried out on a greige polyester/rayon blend fabric. For sample No. 1, the fabric was scoured utilizing the foam process of the present invention. For sample No. 2, conventional enzyme desizing was utilized and for sample No. 3, the foam scour process of the present invention was used in conjunction with a no-wash conventional desizing operation. The compositions utilized as well as the parameters of the processes are set forth in the following table.

TABLE 8

Preparation Procedures

Sample #1 Foam Scouring

6% Hival RS
2% Caustic (50%)
3% Valdet CC
89% Water
Blow ratio 20:1
Horizontal padded % wet pick-up 50%
Batched 4 hours at room temperature
Washed—Hot and cold and dried.

Sample #2 Conventional Enzyme Desizing 3.0% Omega Scour 1116
0.8% Salt
4.0% Enzyme (Super Exsize)
92.2% Water
Padded conventionally. % wet pick-up 76% Steamed atmospheric (210° F.) for 10 min. Washed—Hot and cold and dried.

Sample #3 Foam Scour—No wash Conventional Desizing (a) foam scour application as in #1
(b) batched 4 hours
(c) no intermediate washing
(d) conventional enzyme padding as in #2
(e) steamed for 10 minutes
(f) washed—hot and cold and dried.

Table 9 shows the amount of residual size on the fabrics treated by the above-noted processes. The sample which was only foam scoured exhibited a significantly decreased wax content as compared to the enzyme desized fabric. The combination of the foam scouring and conventional enzyme desizing produced a reduction in both the residual starch as well as the wax.

TABLE 9

Residual Size Analysis

| Sample No. | Preparation Method | Residual Size on Prepared Fabric % Starch | % Wax |
|---|---|---|---|
| 1 | Foam Scouring | 1.22% | 0.09% |
| 2 | Conventional Enzyme Desizing | 0.99% | 0.21% |
| 3. | Foam Scouring and Conventional Desizing | 0.78% | 0.12% |
| Greige (untreated fabric) | | 2.72% (starch + PVA) | 0.5% |

EXAMPLE 10

FOAM MERCERIZATION

A foamable composition was prepared as follows:

| | |
|---|---|
| water | 70% |
| sodium hydroxide | 25% |
| sulfated ethoxylated fatty alcohol foaming agent | 5% |

The composition was foamed to 10:1 blow ratio and was applied to scoured and bleached cotton fabric by horizontal padding of foam (% wet pick up 48%). The fabric sample was then pinned on a frame, skyed for 5 minutes, washed and neutralized while under tension on the pin frame and was dried.

The foam mercerized sample showed improved dye affinity properties comparable to the plant mercerized (conventional) fabric.

We claim:

1. A method for desizing a textile fabric comprising foaming a mixture composed of water, a desizing agent and a foam system to a blow ratio in the range from about 2:1 to 30:1 and a foam density in the range from about 0.5 g/cc to 0.033 g/cc, applying a layer of the foam having a uniform thickness onto the surface of the fabric to be desized in an amount to be effective to desize the fabric, collapsing the foam so that it penetrates into the fabric, batching or steaming the thus treated fabric for a period of time sufficient to allow the desizing agent to separate the size from the fabric and rinsing the fabric.

2. A method for bleaching a textile fabric comprising foaming a mixture composed of water, a bleaching agent, and a foam system to a blow ratio in the range from about 2:1 to 30:1 and a foam density in the range from about 0.5 g/cc to 0.033 g/cc, applying a layer of the foam having a uniform thickness onto the surface of the fabric to be bleached in an amount effective to bleach the fabric, collapsing the foam and forcing the foam into the fabric by applying pressure, batching the thus treated fabric for a period of time sufficient to allow the bleaching agent to separate the bleached impurities from the fabric and rinsing the fabric.

3. A method for scouring a textile fabric comprising foaming a mixture composed of water, a scouring agent, and a foam system to a blow ratio in the range from about 2:1 to 30:1 and a foam density in the range from about 0.5 g/cc to 0.033 g/cc, applying a layer of the foam having a uniform thickness onto the surface of the fabric to be scoured in an amount effective to scour the fabric, collapsing the foam and forcing the foam into the fabric by applying pressure, batching the thus treated fabric for a period of time sufficient to allow the scouring agent to separate the scoured impurities from the fabric and rinsing the fabric.

4. A method for mercerizing a textile fabric comprising foaming a mixture composed of water, mercerizing agents and foam system to a blow ratio in the range from about 2:1 to 30:1 and a foam density in the range from about 0.5 g/cc to 0.033 g/cc by applying a layer of the foam having a uniform thickness onto the surface of the fabric to be mercerized in an amount effective to mercerize the fabric, collapsing the foam and forcing the foam into the fabric by applying pressure and skying to allow the mercerizing agent to mercerize the fabric and rinsing the fabric to separate the mercerizing agents from the fabric.

5. The method of claim 1, 2, 3 or 4, wherein the fabric is subjected to steaming after foam application to expedite desizing, bleaching or scouring.

6. The method of claim 1, 2 or 3 wherein the textile fabric treated contains dyed and undyed yarns.

* * * * *